United States Patent [19]

Goralnik

[11] 4,443,740

[45] Apr. 17, 1984

[54] DIMMER SWITCH FOR A FLUORESCENT LAMP

[76] Inventor: Charles D. Goralnik, 200 Brynwyck Pl., St. Louis County, Mo. 63141

[21] Appl. No.: 366,872

[22] Filed: Apr. 9, 1982

[51] Int. Cl.[3] ..... H05B 41/38

[52] U.S. Cl. ..... 315/284; 315/62; 315/291; 315/362; 315/DIG. 4

[58] Field of Search ..... 315/283, 284, 54, 57, 315/58, 62, 71, 291, 362, DIG. 4

[56] References Cited

U.S. PATENT DOCUMENTS 3,011,095 11/1961 Kriechbaum ..... 315/284 X

FOREIGN PATENT DOCUMENTS 53-18271 2/1978 Japan ..... 315/284

*Primary Examiner*—Eugene R. LaRoche

*Attorney, Agent, or Firm*—Senniger, Powers, Leavitt and Roedel

[57] ABSTRACT

A dimmer switch for a fluorescent lamp having a gaseous discharge light bulb, the switch being adapted to be connected in a ballast circuit including the light bulb and comprising a tapped inductor having a plurality of coil segments connected in series with one another and a plurality of taps or terminals, one at each end of the inductor and one between each adjacent pair of coil segments, with a first one of the end terminals of the inductor being adapted to be connected in the ballast circuit. The switch further comprises a movable switch member for selectively connecting any one of the terminals other than the stated first end terminal in the ballast circuit, whereby, for a given ballast circuit input voltage, the impedance of the inductor as connected in the ballast circuit and thus the ballast circuit current may be varied to produce the desired level of light output of the bulb by adjusting said movable switch member.

3 Claims, 3 Drawing Figures

DIMMER SWITCH FOR A FLUORESCENT LAMP

BACKGROUND OF THE INVENTION

This invention relates to a fluorescent lamp, and more particularly to a dimmer switch for a fluorescent lamp.

Reference may be made to U.S. Pat. No. 4,178,535 disclosing a ballast circuit for a fluorescent lamp having a gaseous discharge light bulb and first and second ballast chokes or inductors housed in a threaded lamp base similar to that of a standard 120 V incandescent light bulb, the ballast circuit being adapted to be connected to a conventional three-way light switch housed in a 120 V light socket or lamp holder to form a dimmer switch for the lamp. In the first position of the three-way switch, the first inductor is connected in the ballast circuit in series with the light bulb while the second inductor is removed from the circuit. In the second position of the switch the second inductor is connected in the ballast circuit in series with the light bulb while the first is removed and, in the third position, a parallel combination of both inductors is connected in the ballast circuit. Because the first and second inductors individually must have an impedance which is low enough to allow a level of ballast current (e.g., a current above approximately 250 ma for a 22-watt bulb) for "starting" the light bulb, yet the parallel combination of the inductors must have an impedance which is high enough to limit the ballast current to a level (e.g., a current below approximately 550 ma for a 22-watt bulb) which will not overheat the filaments of the bulb and thus reduce the life of the bulb, the impedance values of the first and second inductors are similar. Thus, although the three-way light switch provides three different positions and three different connections of the inductors in the ballast circuit, the prior art dimmer switch is capable of producing only two different levels of light output; namely, a low level of light output when either the first or the second inductor alone is connected in the ballast circuit and a high level when the parallel combination of the inductors is connected in the ballast circuit.

SUMMARY OF THE INVENTION

Among the several objects of this invention may be noted the provision of a dimmer switch for a fluorescent lamp which is adjustable for controlling the ballast current flowing through the light bulb so that it produces any one of a plurality of different levels of light output between the upper and lower levels of a range of light outputs; the provision of such a dimmer switch which is capable of selectively including inductive impedance of any one of a plurality of different values in the ballast circuit for controlling the ballast current; the provision of such a dimmer switch which may be used with standard lamp sockets which do not have switches housed therein; and the provision of such a dimmer switch which is relatively compact and economical to manufacture and thus may be used for fluorescent lamps of all sizes, including relatively small, portable lamps.

In general, the invention involves dimmer means for a fluorescent lamp fixture, said fixture comprising a housing carrying a gaseous discharge light bulb, and having means for connection to an electrical outlet, a tapped bullast inductor in the housing, a series of fixed switch contacts in the housing, conductors in the housing interconnecting the taps of the inductor and said contacts, a movable switch contact mounted in the housing for movement into contact selectively with said fixed contacts, said movable switch contact having an operating member extending out through a slot in the housing, the inductor having an end terminal interconnected with said connection means, and the movable switch contact and bulb being interconnected with said connection means for connecting the inductor and the bulb in series via the movable switch contact with the connection means.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
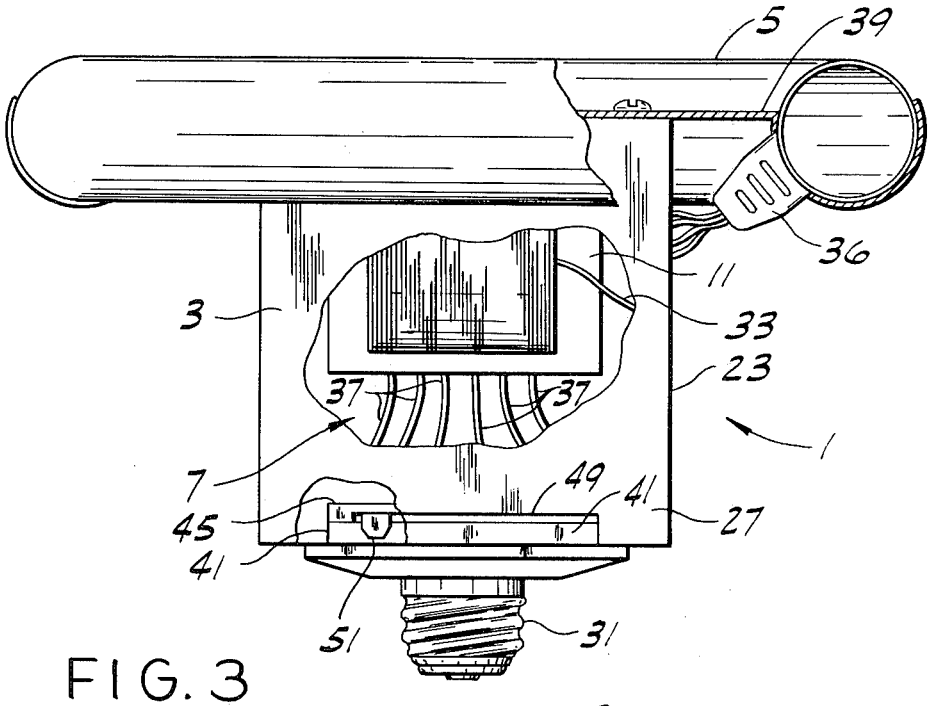
FIG. 1 is a side elevation of a fluorescent lamp comprising a fixture, a light bulb mounted on the fixture, and a dimmer switch of this invention housed in the fixture, portions of the fixture and the bulb being broken away to show interior detail.
Figure 2:
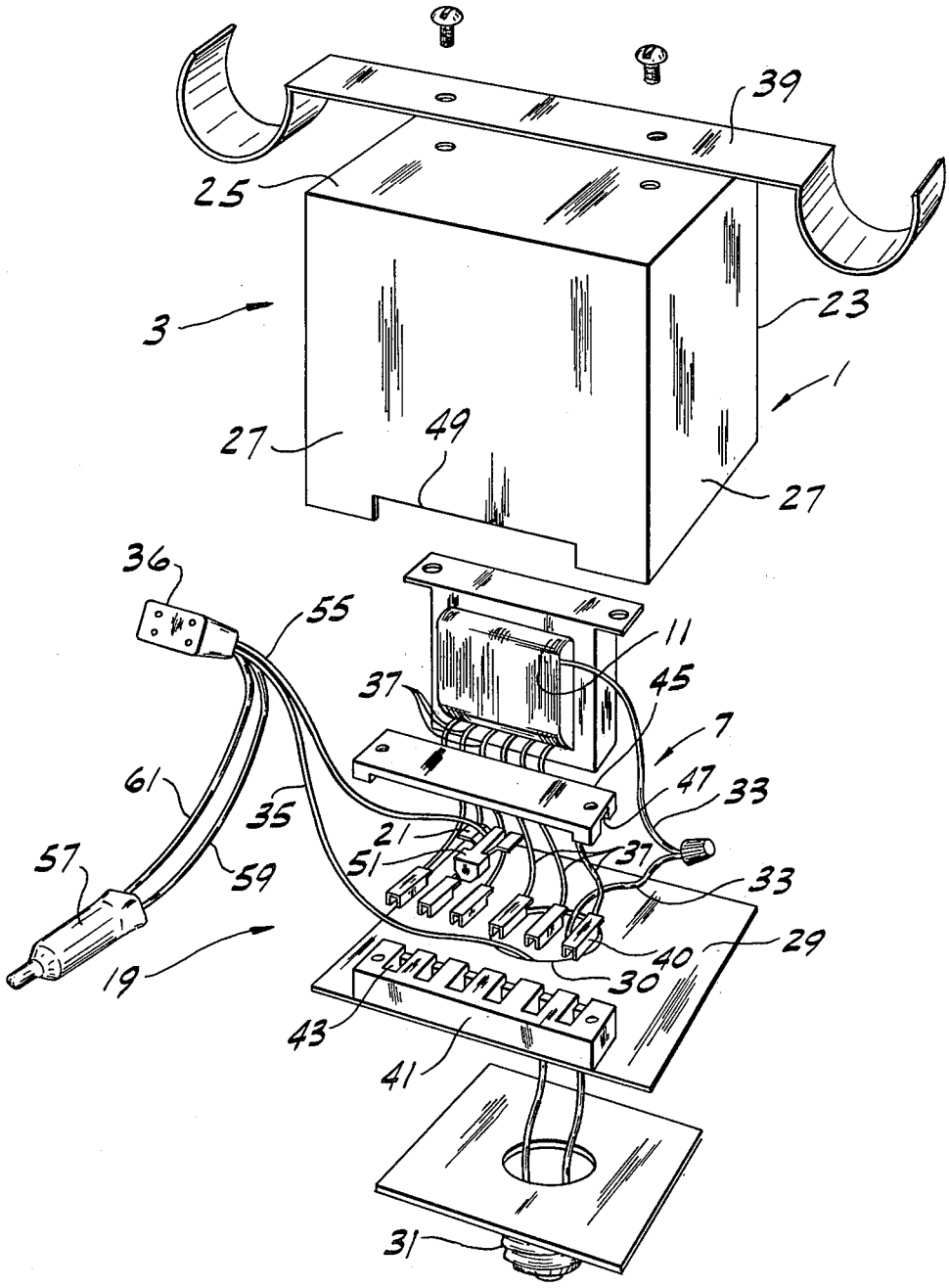
FIG. 2 is an exploded perspective of the lamp showing electrical components of the dimmer switch.

Referring to FIGS. 1 and 2, there is generally indicated at 1 a fluorescent lamp comprising a fixture 3, a conventional gaseous discharge light bulb 5, such as a standard 22-watt fluorescent light bulb of annular shape, mounted on the fixture and a dimmer switch of this invention indicated generally at 7 housed within the fixture. The light bulb 5 and dimmer switch 7 are electrically connected in a ballast circuit 9 of the fluorescent lamp, illustrated in FIG. 3. To enable proper operation of the bulb 5, the current flowing through the ballast circuit 9 must be sufficient (e.g., above approximately 250 ma for the 22-watt bulb shown in FIGS. 1 and 2) to enable the arc between the filaments of the bulb to be struck for "starting" the lamp, but not so great (e.g., below approximately 550 ma for the 22-watt bulb) to prevent the filaments of the bulbs from being overheated, which would shorten the life of the bulb. Within this operting range of ballast currents, the bulb 5 produces an increasing level of light output with increased ballast current. As described more fully hereinafter, the dimmer switch 7 is selectively adjustable for controlling ballast circuit current within the operating range of ballast currents for producing the desired level of light output from the light bulb 5.

Figure 3:
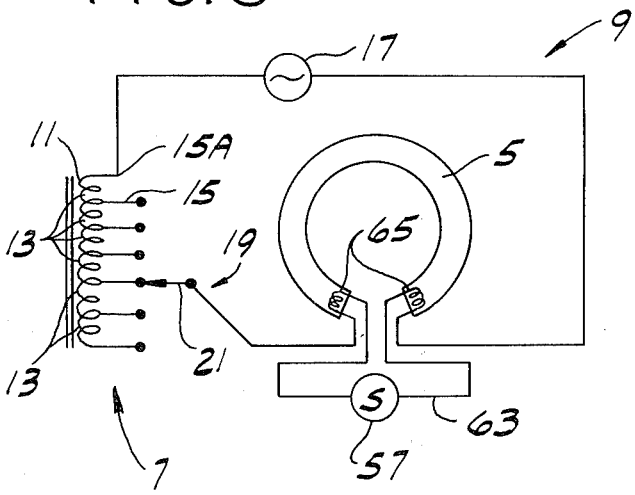
FIG. 3 is a circuit diagram of a ballast circuit of the lamp which includes the dimmer switch.

As shown in FIG. 3, the dimmer switch 7 comprises ballast means in the form of a tapped inductor 11 comprising a plurality of serially arranged coil segments, each designated 13 and each constituting an inductive impedance. The inductor 11 further has a plurality of terminals or coil taps 15 (seven such taps 15 as illustrated in FIG. 3), one at each end of the inductor and one between each adjacent pair of serially arranged coil segments. The tap, designated 15A at one end of the coil is electrically connected to a source of power designated 17, and thus constitutes a power input terminal for the inductor. The other taps 15 constitute fixed contacts of a conventional signle pole, multiple throw switch, such as a multiple position slide selector switch, generally designated 19 in FIG. 3, having a movable switch member 21 electrically connected in the ballast circuit and engageable with the taps 15 for selectively connecting any of these taps in the ballast circuit 9.

The impedance of the inductor 11 as measured between the power input terminal 15A and the tap 15 adjacent thereto (i.e., the lowest impedance value of the inductor 11 which may be connected in the ballast circuit 9) is such as to limit the ballast circuit current to a value below that which would overheat the filaments of the bulb, and the impedance of the inductor as measured between the power input terminal 15A and the tap at the opposite end of the inductor (i.e., the highest impedance value of the inductor which may be connected in the ballast circuit) is such as to allow a ballast circuit current which is slightly greater than that required for starting the light bulb. The impedance of the inductor as measured between the power input terminal 15A and each of the remaining taps 15 thus falls within the range between the stated highest and lowest impedance values of the inductor. Accordingly, with a given power supply voltage, the position of the movable switch member 21 may be adjusted to vary the inductive impedance of the inductor, as connected in the ballast circuit, between its highest and lowest values, thereby controlling the ballast current in a range between the starting and overloading ballast current values for producing the desired level of light output from the light bulb.

As best illustrated in FIG. 2, the fixture 3 comprises a box-like housing 23 of suitable sheet material, such as molded plastic, having a wall 25 at one end thereof (i.e., its upper end as shown), side walls 27 depending from the upper end wall 25 and a bottom 29 having a central opening 30 therein removably secured to the side walls by conventional fasteners (not shown) for closing the lower end of the housing. A threaded projection 31, similar to the base of a standard 120 V incandescent light bulb, is mounted on the underside of the bottom 29 of the housing over the opening 30 by conventional fasteners (not shown). The projection 31 is adapted to be threaded in a standard 120 V light socket or bulb holder, and is electrically connected via wires 33, 35 to the inductor 11 and to a connector 36 for the bulb 5, respectively, for providing power to the ballast circuit 9 from the source 17. A support 39 comprising a bar of suitable material formed to have generally U-shaped ends receiving the bulb 5 therein is mounted on the upper end wall 25 of the fixture and projects laterally therefrom for supporting the bulb in surrounding relation to the housing 23.

The tapped inductor 11 is mounted in the fixture adjacent the upper end 25 thereof, with each tap 15 of the inductor comprising a wire 37 depending from the inductor and terminating in a conductive terminal clip 40. The slide selector switch 19 is mounted on the bottom 29 of the fixture at a side thereof and comprises a base member 41 having a plurality of recesses 43 (i.e., six such recesses 43, as illustrated) for holding the terminal clips 40, and a cover member 45 secured to the base member by fasteners (not shown) and having a groove 47 extending the length thereof. The movable switch member 21 is electrically connected by a wire 55 to the connector 36, and is carried on a handle 51 formed of suitable electrically insulating material extending laterally outwardly with respect to a side of the housing 23 from an inner end thereof between the base and cover members 41, 45, through a recess 49 in the lower end of the respective side wall, to an enlarged outer end. The movable switch member 21 is formed of a strip of suitable electrically conductive sheet material such as copper, and, as formed, has a V-shaped central portion engageable with the terminal clips 40 and a pair of side portions slidable in the groove 47 in the cover member 45. A conventional glow-bottle starting switch 57 is electrically connected by wires 59, 61 to the connector 36, the starting switch being operable to complete a starting circuit designated 63 in FIG. 3 including the bulb cathodes 65 to preheat them to enable the arc to be struck between the cathodes for starting the bulb.

It will be observed from the above that the dimmer switch 7 of this invention is operable selectively to connect an inductive impedance of any one of a plurality of different values in the ballast circuit for controlling the ballast current withing the range between the starting and overloading ballast currents for producing the desired level of light output.

While the dimmer switch of this invention is shown and described as being mounted in the fixture of a relatively small, portable lamp 1, it is contemplated that it may also be used with fluorescent lamps of the so-called "light fixture" type which are relatively large and intended to be permanently mounted in a building, and may be mounted independently of the fixture of the lamp. Moreover, it is also contemplated that the dimmer switch of this invention may be operatively associated with or "ganged" to an on-off switch for the ballast circuit.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Dimmer means for a fluorescent lamp fixture, said fixture comprising a housing carrying a gaseous discharge light bulb, and having means for connection to an electrical outlet, a tapped ballast inductor in the housing, a series of fixed switch contacts in the housing, conductors in the housing interconnecting the taps of the inductor and said contacts, a movable switch contact mounted in the housing for movement into contact selectively with said fixed contacts, said movable switch contact having an operating member extending out through a slot in the housing, the inductor having an end terminal interconnected with said connection means, and the movable switch contact and bulb being interconnected with said connection means for connecting the inductor and the bulb in series via the movable switch contact with the connection means.

2. Dimmer means as set forth in claim 1 wherein the fixed contacts are mounted in a straight line in the housing and the movable switch contact is mounted for sliding movement along said line for selective engagement with said fixed contacts.

3. Dimmer means as set forth in claim 1 wherein the connection means is a screw-threaded plug on the housing adapted to be threaded into a standard lamp socket.

* * * * *